US009511253B1

(12) United States Patent
Miller

(10) Patent No.: US 9,511,253 B1
(45) **Date of Patent: *Dec. 6, 2016**

(54) ELLIPTICAL EXERCISE DEVICE

(71) Applicant: Larry D. Miller, Rochester, MI (US)
(72) Inventor: Larry D. Miller, Rochester, MI (US)
(73) Assignee: Larry D. Miller Trust, Rochester, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/061,031

(22) Filed: Mar. 4, 2016

Related U.S. Application Data

(63) Continuation-in-part of application No. PCT/US2015/034146, filed on Jun. 4, 2015, which is a (Continued)

(51) Int. Cl.
*A63B 22/00* (2006.01)
*A63B 22/06* (2006.01)
(Continued)

(52) U.S. Cl.
CPC ..... *A63B 22/001* (2013.01); *A63B 21/00069* (2013.01); *A63B 21/00076* (2013.01); *A63B 21/225* (2013.01); *A63B 22/0015* (2013.01);
(Continued)

(58) Field of Classification Search
USPC ..... 482/51–65
See application file for complete search history.

(56) References Cited

U.S. PATENT DOCUMENTS 5,518,473 A 5/1996 Miller
5,577,985 A 11/1996 Miller
(Continued)

FOREIGN PATENT DOCUMENTS

AU 2007202574 A1 1/2009

*Primary Examiner* — Stephen Crow
(74) *Attorney, Agent, or Firm* — Dinsmore & Shohl LLP; Douglas L. Wathen

(57) ABSTRACT

Embodiments of the present invention have left and right guide links that are pivotally attached to the frame, typically to an upper part of the frame, and left and right foot support links each having a mid-portion pivotally interconnected with a lower end of the respective guide link. Reciprocal motion of the guide links causes the foot support links to move along a path having a horizontal component of motion (i.e. fore and aft). Left and right vertical control links are coupled to a vertical cam drive such that the vertical cam drive reciprocates the vertical control links. The vertical control links are each coupled to a forward portion of the respective foot support link such that the reciprocating control links cause foot receiving areas at the rear of the respective foot support links to reciprocate along a path having a vertical component of motion (i.e. upwardly and downwardly). In free stride versions, the motion of the guide links may be coordinated by a horizontal coordination linkage, such that the left and right guide links move equally in opposite directions, and the guide links are not coupled to the drive system. In fixed path versions, the guide links may be coupled to a drive or crank system, which may be part of the vertical cam drive. The coupling of the control links and/or guide links to the drive system or systems may be adjustable so as to adjust the amount of vertical and/or horizontal motion, and this adjustment may be manual or powered, and may be coordinated such that as horizontal motion is increased or decreased, vertical motion is increased or decreased, or vice versa. As will be clear to those of skill in the art, any of the embodiments described herein may be converted between free stride and fixed path by adding or removing the appropriate links or couplings.

22 Claims, 8 Drawing Sheets

Related U.S. Application Data continuation of application No. 14/643,587, filed on Mar. 10, 2015, now Pat. No. 9,072,936, said application No. PCT/US2015/034146 is a continuation of application No. 14/643,522, filed on Mar. 10, 2015, now Pat. No. 9,061,175, application No. 15/061,031, which is a continuation-in-part of application No. PCT/US2015/031378, filed on May 18, 2015, which is a continuation of application No. 14/713,047, filed on May 15, 2015, now Pat. No. 9,192,811, which is a continuation-in-part of application No. 14/476,083, filed on Sep. 3, 2014, now abandoned, said application No. PCT/US2015/031378 is a continuation of application No. 14/476,083.

(60) Provisional application No. 62/086,470, filed on Dec. 2, 2014, provisional application No. 62/000,671, filed on May 20, 2014.

(51) Int. Cl.
*A63B 21/00* (2006.01)
*A63B 21/22* (2006.01)

(52) U.S. Cl.
CPC .... *A63B 22/0664* (2013.01); *A63B 2022/0682* (2013.01)

(56) References Cited

U.S. PATENT DOCUMENTS 5,611,756 A 3/1997 Miller
5,788,610 A * 8/1998 Eschenbach ..... A63B 22/001 482/51
5,911,649 A 6/1999 Miller
5,957,814 A * 9/1999 Eschenbach ..... A63B 22/001 482/51
6,019,710 A 2/2000 Dalebout et al.
6,045,487 A * 4/2000 Miller ..... A63B 21/00178 482/51
6,113,518 A 9/2000 Maresh et al.
6,126,574 A 10/2000 Stearns et al.
6,168,552 B1 * 1/2001 Eschenbach ..... A63B 22/001 482/51
6,171,215 B1 * 1/2001 Stearns ..... A63B 22/001 482/51
6,196,948 B1 * 3/2001 Stearns ..... A63B 22/001 482/51
6,283,895 B1 * 9/2001 Stearns ..... A63B 22/0015 482/51
6,422,976 B1 * 7/2002 Eschenbach ..... A63B 22/001 482/51
6,422,977 B1 * 7/2002 Eschenbach ..... A63B 22/001 482/51
6,440,042 B2 * 8/2002 Eschenbach ..... A63B 22/001 482/51
6,689,119 B1 2/2004 Di Caprio et al.
6,758,790 B1 7/2004 Ellis
6,929,587 B2 8/2005 Charnitski
7,052,438 B2 5/2006 Eschenbach
7,060,005 B2 * 6/2006 Carlsen ..... A63B 22/001 482/52
7,101,316 B2 9/2006 Rosenow et al.
7,104,929 B1 * 9/2006 Eschenbach ..... A63B 22/0015 482/52
7,160,230 B2 1/2007 Tremblay
7,169,089 B2 1/2007 Rodgers, Jr.
7,169,090 B1 * 1/2007 Maresh ..... A63B 22/0007 482/51
7,172,531 B2 * 2/2007 Rodgers, Jr. ..... A63B 22/001 482/52
7,201,705 B2 * 4/2007 Rodgers, Jr. ..... A63B 22/001 482/52
7,214,168 B2 * 5/2007 Rodgers, Jr. ..... A63B 22/001 482/52
7,462,134 B2 12/2008 Lull et al.
7,556,591 B2 * 7/2009 Chuang ..... A63B 22/001 482/51
7,591,761 B1 9/2009 Ellis
7,651,445 B1 1/2010 Chen
7,651,446 B1 * 1/2010 Eschenbach ..... A63B 22/001 482/140
7,678,025 B2 3/2010 Rodgers, Jr.
7,708,668 B2 5/2010 Rodgers, Jr.
7,749,137 B2 7/2010 Watt et al.
7,758,473 B2 7/2010 Lull et al.
7,794,362 B2 9/2010 Miller
7,828,698 B2 11/2010 Rodgers, Jr.
7,841,968 B1 11/2010 Eschenbach
7,938,754 B2 5/2011 Eschenbach
8,029,416 B2 10/2011 Eschenbach
8,092,351 B1 1/2012 Rodgers, Jr.
8,133,159 B2 * 3/2012 Eschenbach ..... A63B 21/00069 482/52
8,303,470 B2 11/2012 Stewart et al.
8,317,663 B2 11/2012 Stewart et al.
8,597,161 B2 12/2013 Dibble et al.
8,663,072 B2 3/2014 Stewart et al.
8,668,627 B2 * 3/2014 Eschenbach ..... A63B 21/00069 482/51
8,740,754 B2 * 6/2014 Miller ..... A63B 22/001 482/51
8,974,352 B2 * 3/2015 Eschenbach ..... A63B 22/0017 482/51
8,979,714 B2 3/2015 Miller
9,061,175 B1 * 6/2015 Miller ..... A63B 22/0664
9,072,936 B1 7/2015 Miller et al.
9,192,811 B1 11/2015 Miller
9,199,115 B2 * 12/2015 Yim ..... A63B 23/03516
2001/0016541 A1 8/2001 Maresh et al.
2006/0172865 A1 8/2006 Dey et al.
2007/0087907 A1 * 4/2007 Rodgers, Jr. ..... A63B 21/05 482/52
2007/0117683 A1 * 5/2007 Ercanbrack ..... A63B 22/001 482/52
2012/0108402 A1 5/2012 Rodgers, Jr.
2012/0277066 A1 * 11/2012 Hsu ..... A63B 22/001 482/57
2013/0012363 A1 1/2013 Eschenbach
2014/0148311 A1 5/2014 Eschenbach
2014/0296036 A1 10/2014 Miller
2014/0336006 A1 11/2014 Miller
2015/0182787 A1 * 7/2015 Liu ..... A63B 22/001 482/52
2016/0059067 A1 * 3/2016 Miller ..... A63B 21/154 482/52

* cited by examiner

ELLIPTICAL EXERCISE DEVICE

CROSS-REFERENCE TO RELATED APPLICATION

This application claims priority from international application Serial No. PCT/US2015/031378, filed May 18, 2015, and international application Serial No. PCT/US2015/034146, filed Jun. 4, 2015. PCT/US2015/031378 claims priority from U.S. patent application Ser. No. 14/713,047, filed May 15, 2015; U.S. patent application Ser. No. 14/476,083, filed Sep. 3, 2014; and U.S. provisional patent application Ser. No. 62/000,671, filed May 20, 2014. PCT/US2015/034146 claims priority to U.S. patent application Ser. No. 14/643,587, filed Mar. 10, 2015; U.S. patent application Ser. No. 14/643,522, filed Mar. 10, 2015; and U.S. provisional patent application Ser. No. 62/086,470, filed Dec. 2, 2014. The entire contents of all of the aforementioned application are incorporated herein by reference.

FIELD OF THE INVENTION

This invention relates generally to elliptical exercise devices in which the path of travel of a user's foot is generally elliptical.

BACKGROUND OF THE INVENTION

There are a number of exercise devices that operate to allow a user to implement a foot action following a generally closed, curved path of travel, simulating running and/or walking. These devices are generally referred to as "elliptical" exercise devices. Many such elliptical exercise devices are large, complicated, costly, and/or have undesirable characteristics related to the motion of the user's feet.

U.S. Pat. No. 5,518,473 to Miller shows an early design for an elliptical exercise device. The device provides a path of travel that simulates running and/or walking but is quite large and does not provide for arm exercise.

U.S. Pat. No. 5,611,756 to Miller discloses an elliptical exercise device with arm and leg movement. A pair of guide links are pivotally supported on a frame and a foot engaging link is supported at the lower end of each guide link. An intermediate link connects each guide link to crank. A control link joins each foot link to the corresponding intermediate link to vary the angle of the foot link relative to the guide link.

U.S. Pat. No. 6,045,487 to Miller discloses an elliptical exercise device having a pair of guide links pivotally supported on a frame and a foot link supported at the lower end of each guide link. An intermediate link connects each guide link to a crank of a crank system. A flexible control member engages each foot link and extends up and over a pulley located at the guide link pivot axis. The control members connect to a reciprocating assembly for moving the foot links up and down as the guide links pivot back and forth.

U.S. Pat. No. 7,708,668 to Rodgers, Jr. shows several embodiments of an exercise device having flexible elements coupling left and right foot support members to a crank system. The exercise device allows for a variable stride length and decouples the vertical and horizontal components of foot travel.

U.S. Pat. No. 7,556,591 to Chuang et al. discloses an exercise device with cranks mounted to an upper portion of a frame. Two handles are pivoted to the frame forward of the cranks. Foot supports are pivotally coupled to the lower ends of the handles. Pivot rods extend between each foot support and one of the cranks. Additional links connect each handle with the same cranks as the respective pivot rod.

SUMMARY OF THE INVENTION

The present invention offers several embodiments of an elliptical exercise device. Some embodiments offer a path of motion with desirable characteristics. In addition, some embodiments are compact in form and have reduced mechanical complexity.

A first embodiment of an elliptical exercise device includes a frame configured to be supported on a horizontal surface. The frame has a first pivot axis and a second pivot axis defined thereon. The second pivot axis is forward of the first pivot axis. A first and second guide link each have a first and a second attachment point defined thereon. Each guide link is pivotally attached, through its first attachment point, to the frame at the first pivot axis thereof. A first and a second foot support link each have a rear portion, a mid portion, and a forward portion. The rear portion of each support link defines a foot receiving area configured to support a user's foot thereon. The mid portion of each foot support link is pivotally connected to the second attachment point of a respective one of the guide links so that when the guide links reciprocate relative to the frame, they cause their respective foot support link to move in a path of travel having a horizontal component of motion. A cam drive has a first and second cam supported for rotation about the second pivot axis and a first and a second pivoting arm engaging the respective first and second cams such that rotation of the cams causes movement of the pivoting arms. First and second rigid vertical control links each having a first end coupled to the forward portion of a respective one of the foot support links and a second end coupled to a respective one of the pivoting arms of the cam drive such that rotation of the cams about the second pivot axis pivots the foot support links with respect to the guide links and the foot receiving areas move in a path of travel having a vertical component of motion. The pivotal motion of the guide links about the first attachment points is decoupled from the motion of the foot receiving areas along the path of travel having a vertical component of motion so that the user can achieve a foot path that is generally vertical or generally horizontal or a blend of vertical and horizontal motion.

In some versions, each of the guide links has a guide length defined between the first and second attachment point and each of the vertical control links has a length that is in the range of 60-100% of the guide length.

In some versions, each of the vertical control links is generally parallel with the respective one of the guide links when the respective one of the guide links is generally vertical.

In some versions, the foot support links are supported for movement only by the respective guide link and vertical control link.

In some versions, each of the cams has a generally non-circular shape.

In some versions, the pivoting arms each have a pivot end, an opposite control end, and a midportion therebetween, and the second end of each of the vertical control links is connected to the control end of a respective one of the pivoting arms. The pivot arms may each further having a follower connected to the midportion, with each follower contacting an outer surface of a respective one of the cams. Alternatively or additionally, each pivoting arm is generally horizontal when the respective foot receiving area is midway through its vertical path of travel. The pivot end of the pivoting arms may be rearward of the control ends. The pivoting arms may be disposed below the cams such that each cam pushes downwardly on the respective pivoting arm.

In some versions, the first pivot axis is higher than the second pivot axis.

In some versions, the foot support links are generally horizontal when the respective foot receiving area is midway through its vertical path of travel.

In some versions, each guide link further includes a hand grip portion extending upwardly from the first attachment point.

In some versions, the device further includes a horizontal coordination linkage linking the first guide link to the second guide link such that pivotal movement of one of the guide links in a first direction causes pivotal movement of the other of the guide lines in an opposite direction. A flywheel and resistance assembly may be coupled to the horizontal coordination linkage.

In some versions, the device further includes a flywheel and resistance assembly coupled to the cam drive.

Some versions of the exercise device further include an adjustment mechanism for adjusting a range of vertical travel. The adjustment mechanism may include a first sliding collar coupled to the first pivoting arm and a second sliding collar coupled to the second pivoting arm, the second end of each of the vertical control links being coupled to the sliding collar of the respective pivoting arm. The adjustment mechanism may also include an actuator operable to move the sliding collars on the pivoting arms. The adjustment mechanism may include a first and a second biasing element each biasing a respective one of the sliding collars away from the pivot end of the respective one of the pivoting arms and a first and a second flexible element each connecting a respective one of the sliding collars to the actuator such that movement of the actuator causes movement of the sliding collars.

The adjustment mechanism may include a first sliding collar coupled to the forward end of the first foot support link and a second sliding collar coupled to the forward end of the second foot support link, the first end of each of the vertical control links being coupled to the sliding collar on the respective foot support link arm, the adjustment mechanism further comprising an actuator operable to move the sliding collars on the foot support links. The adjustment mechanism may also include a first and a second biasing element each biasing a respective one of the sliding collars away from the mid portion of the respective one of the foot support links and a first and a second flexible element each connecting a respective one of the sliding collars to the actuator such that movement of the actuator causes movement of the sliding collars.

The adjustment mechanism may be operable to automatically adjust the range of vertical travel as the user changes the range of horizontal travel.

DETAILED DESCRIPTION OF THE PREFERRED EMBODIMENTS

Figure 1:
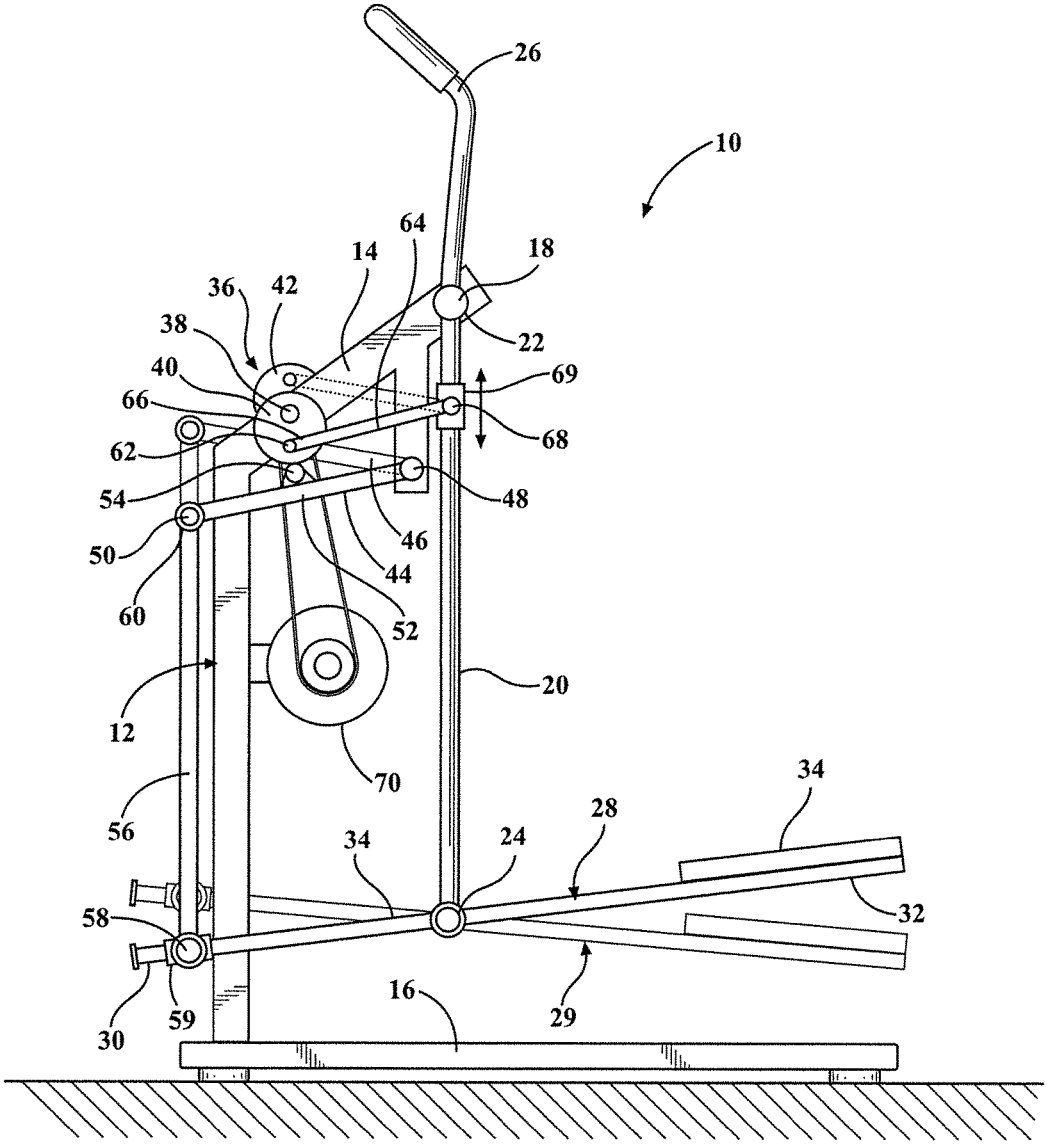
FIG. 1 is a side elevational view of a fixed path embodiment of an elliptical exercise device in accordance with the present invention.

The present invention will be explained with reference to several particular embodiments, including variations and optional features of these embodiments. It is to be understood that yet other embodiments, modifications, and variations thereof will be apparent to those of skill in the art in view of the teaching presented herein. Further, features and elements of certain embodiments may be combined with each other in combinations other than those illustrated, and variations and optional features may be used with any of the embodiments.

The present invention relates to exercise devices which are often referred to as elliptical exercise devices. An elliptical exercise device is designed to be used by a user placing their feet on respective foot receiving areas and then moving their feet along a generally elliptical path. This path will have horizontal and vertical components. The term "elliptical exercise device" is used herein in its broad sense to include both free stride exercise devices and fixed path exercise devices.

In a free stride exercise device, the motion of the foot receiving areas along a path of travel having a horizontal component of motion is generally decoupled from motion of the foot receiving areas along a path of travel having a vertical component of motion. Typically, a free stride exercise device will allow a user to alter the length of the horizontal path of travel by exerting more or less fore-aft force to the foot receiving areas or associated hand grip areas. Typically, such a device will have a coordination linkage that coordinates the horizontal travel such that as one foot receiving area moves rearwardly, the other foot receiving area moves forwardly by an equal amount. Typically, a resistance element is also provided to provide resistance to the horizontal motion, though this is not mandatory. In a free stride device, the vertical motion is typically controlled by some type of vertical drive system that is coupled to the foot receiving areas and causes the foot receiving areas to oscillate upwardly and downwardly by a predetermined amount. The height of the vertical travel may or may not be adjustable. In some free stride devices, the path of travel may be adjusted so as to be primarily horizontal so as to mimic a striding or cross-country skiing motion, primarily vertical so as to mimic a climbing motion, or a combination of horizontal and vertical such that the foot receiving areas travel along a curved generally elliptical path. The term "generally elliptical" is intended to mean any curved path and is not limited to a strictly mathematical ellipse.

A fixed path elliptical exercise device is one in which the foot receiving areas travel along a path that is determined by the device rather than by the amount of force applied by the user. The amount of horizontal or vertical travel may be non-adjustable such that the foot receiving areas travel through a single predetermined path. Alternatively, the horizontal or the vertical travel, or both, may be adjustable so as to change the length, height, and/or shape of the elliptical path. In some embodiments, the present invention may also be useful as a stepper or striding type exercise device that may not typically be considered an elliptical exercise device.

Embodiments of the present invention have left and right guide links that are pivotally attached to the frame, typically to an upper part of the frame, and left and right foot support links each having a mid-portion pivotally interconnected with a lower end of the respective guide link. Reciprocal motion of the guide links causes the foot support links to move along a path having a horizontal component of motion (i.e. fore and aft). Left and right vertical control links are coupled to a vertical cam drive such that the vertical cam drive reciprocates the vertical control links. The vertical control links are each coupled to a forward portion of the respective foot support link such that the reciprocating control links cause foot receiving areas at the rear of the respective foot support links to reciprocate along a path having a vertical component of motion (i.e. upwardly and downwardly). In free stride versions, the motion of the guide links may be coordinated by a horizontal coordination linkage, such the left and right guide links move equally in opposite directions, and the guide links are not coupled to the drive system. In fixed path versions, the guide links may be coupled to a drive or crank system, which may be part of the vertical cam drive. The coupling of the control links and/or guide links to the drive system or systems may be adjustable so as to adjust the amount of vertical and/or horizontal motion, and this adjustment may be manual or powered, and may be coordinated such that as horizontal motion is increased or decreased, vertical motion is increased or decreased, or vice versa. As will be clear to those of skill in the art, any of the embodiments described herein may be converted between free stride and fixed path by adding or removing the appropriate links or couplings.

FIG. 1 provides a side elevational view of a first embodiment of an elliptical exercise device 10 structured in accord with the principles of the present invention. This embodiment is a fixed path embodiment. The device includes a frame 12 which is configured and operative to retain and support the various other components of the device on a horizontal surface such as a floor. The frame may be said to have an upper portion 14 and a lower portion 16, with the lower portion configured to contact the horizontal surface while the upper portion supports various components of the device 10. The frame 12 is typically fabricated from metal and/or composite materials, but any material may be used. A first pivot axis 18 is defined in the upper portion 14 of the frame 12. The frame 12 may be said to have a forward portion that is forward of the first pivot axis 18, which is to the left in the view of FIG. 1. The upper portion 14 of the frame of this embodiment substantially lacks any rearward portion rearward of the first pivot axis 18.

A pair of guide links are pivotally interconnected with the frame so as to be pivotable about the first pivot axis 18. A first guide link 20 is shown at the midpoint of its travel, wherein it is generally vertical. At this position, the second guide link is also generally vertical and disposed directly behind the first guide link 20, and is therefore not visible in FIG. 1. All left and right components may alternatively be referred to as first and second components for ease of description.

The guide link 20 may be said to have a first attachment point 22 towards its upper end and a second attachment point 24 at its lower end. The guide link 20 is pivotally interconnected with the first pivot axis 18 of the frame 12 at its first attachment point 22. In the illustrated embodiment, the guide link 20 further includes a hand grip portion 26 extending upwardly from the first attachment point 22.

The exercise device 10 further includes a first foot support link 28 and a second foot support link 29. Each foot support link 28 and 29 is pivotally interconnected with a respective one of the guide links. The foot support link 28 may be said to have a forward portion 30 at its forward end, a rear portion 32 at its rearward end, and a mid portion 34 extending between the forward portion and rear portion. As shown, the mid portion 34 of the foot support link 28 is pivotally interconnected with the lower end of the guide link 20, at the second attachment point 24 of the guide link 20. The rear portion 32 of the foot support link 28 defines a foot receiving area 34 that is configured to support a user's foot thereon. It should be noted that references to forward and rearward are made with respect to a direction a user is facing when using the device 10. A user places their feet on the foot receiving areas of the foot support links and faces towards the hand grip portions 26. As such, "forward" is to the left in FIG. 1 and "rearward" is to the right.

A combination vertical and horizontal drive system 36 is pivotally interconnected with the frame 12 such that the drive system 36 rotates about a second pivot axis 38 defined on the frame. In the illustrated embodiment, the second pivot axis 38 is forward of the first pivot axis 18 on the upper portion 14 of the frame 12. This means that the second pivot axis 38 is also on the forward portion of the frame. In the illustrated embodiment, the second pivot axis is a short distance lower than the first pivot axis 18.

The combination drive system 36 includes a cam drive for driving vertical motion of the foot receiving areas and a crank or crank portion for pivoting the guide links about the first pivot axis 18, thereby causing horizontal motion of the foot receiving areas. The cam drive includes cams 40 and 42 that are each supported for rotation about the second pivot axis 38. In this embodiment, the cams are each circular with the centers of the circular cams being offset from the second pivot axis. The cam drive further includes first and second pivoting arms, 44 and 46 respectively. The first pivoting arm 44 has a pivot end 48 that is pivotally attached to the forward portion of the frame. The pivoting arm 44 extends forwardly to an opposite control end 50. A mid portion 52 of the pivoting arm 44 contacts the outer surface of the cam 40 such that as the cam rotates about the axis 38, the pivoting arm pivots about the pivot end 48 and the control end oscillates. In the illustrated embodiment, the pivoting arm 44 has a follower 54 attached thereto, and the follower contacts the outer surface of the cam. The follower may be a roller follower. In this embodiment, the pivoting arms are generally horizontal at a mid-point of their travel, which corresponds to the respective foot receiving area being midway through its vertical path of travel. As shown, the pivoting arms are disposed below the cams such that the cams push downwardly on the pivoting arms.

First and second vertical control links couple the pivoting arms to the respective foot support links to provide vertical motion to the foot receiving areas. Vertical control link 56 has a lower or first end 58 coupled to the forward portion 30 of the foot support link 28 and an upper or second end 60 coupled to the control end 50 of the pivoting arm 52. In this embodiment, the vertical control links extend generally vertically between the upper and lower ends.

The drive system 36 further includes a crank portion for moving the guide links.

Specifically, a first crank arm is formed by an attachment point 62 on the first cam 40. The attachment point 62 is offset from the second pivot axis 38. Alternatively, a physically separate crank arm may be provided. A first horizontal control link 64 has a forward end 66 coupled to the attachment point 62 and a rearward end 68 coupled to the guide link 20 below the first pivot axis. As such, as the crank arm formed by the attachment point 62 rotates about the second pivot axis 38, the horizontal control link reciprocates forwardly and rearwardly, thereby pivoting the guide link 20 about the first pivot axis 18 and moving the foot support link 28 and foot receiving area 34 along a path of travel having a horizontal component of motion. In this embodiment, the horizontal control links extend generally horizontally rearwardly to the guide links. In alternative versions, the crank portion may connect with the guide links in other ways. The horizontal and vertical motions are typically out of phase, such that as when the foot receiving area is at its forwardmost or rearwardmost position, it is midway through its vertical travel range.

As shown, a flywheel and resistance assembly 70 may be coupled to the drive system 36 to provide inertia and resistance. A pulley may form part of or be interconnected with the drive system 36 and be connected to a flywheel by a belt. The flywheel and/or pulley may include a load element such as an electrical or frictional resistance device. Alternatively, a flywheel and/or load element may be integrated with the drive system 36 or connected to the remainder of the device in other ways.

As discussed above, the vertical control link 56 extends generally vertically when the respective foot support link 28 is midway through its horizontal path of travel. It is also generally parallel to the main body of the guide link 20. Both the vertical control link 56 and guide link 20 will be angled with respect to vertical when the respective foot support link 28 is near its forward or rearward position. However, the vertical control link 56 remains generally parallel to the main body of the guide link 20. As also shown, the vertical control link 56 has a length that is similar to the length of the guide link 20. Specifically, the guide link 20 may be said to have a working or guide length defined between the first attachment point 22 and second attachment point 24. In some embodiments, the length of the vertical control link 56 is similar to the working length of the guide link 20. In some embodiments, the length of the vertical control link 56 is in the range of 60% to 100% of the guide length of the guide link 20. This arrangement provides a generally parallelogram linkage and a desirable motion profile. For some embodiments, the elements are considered to be "generally parallel" if they are within twenty five (25) degrees of each other, and in certain embodiments the elements are considered to be "generally vertical" or "generally horizontal" if they are within twenty five (25) degrees of vertical or horizontal, respectively. In some cases, the reference to "generally vertical" or "generally horizontal" refers to the element when it is in the middle of its range of travel. In further embodiments, generally parallel and generally horizontal or vertical means within twenty (20) degrees of absolute and, in still further embodiments, these tell is mean that an element is within ten (10) degrees of absolute.

Figure 2:
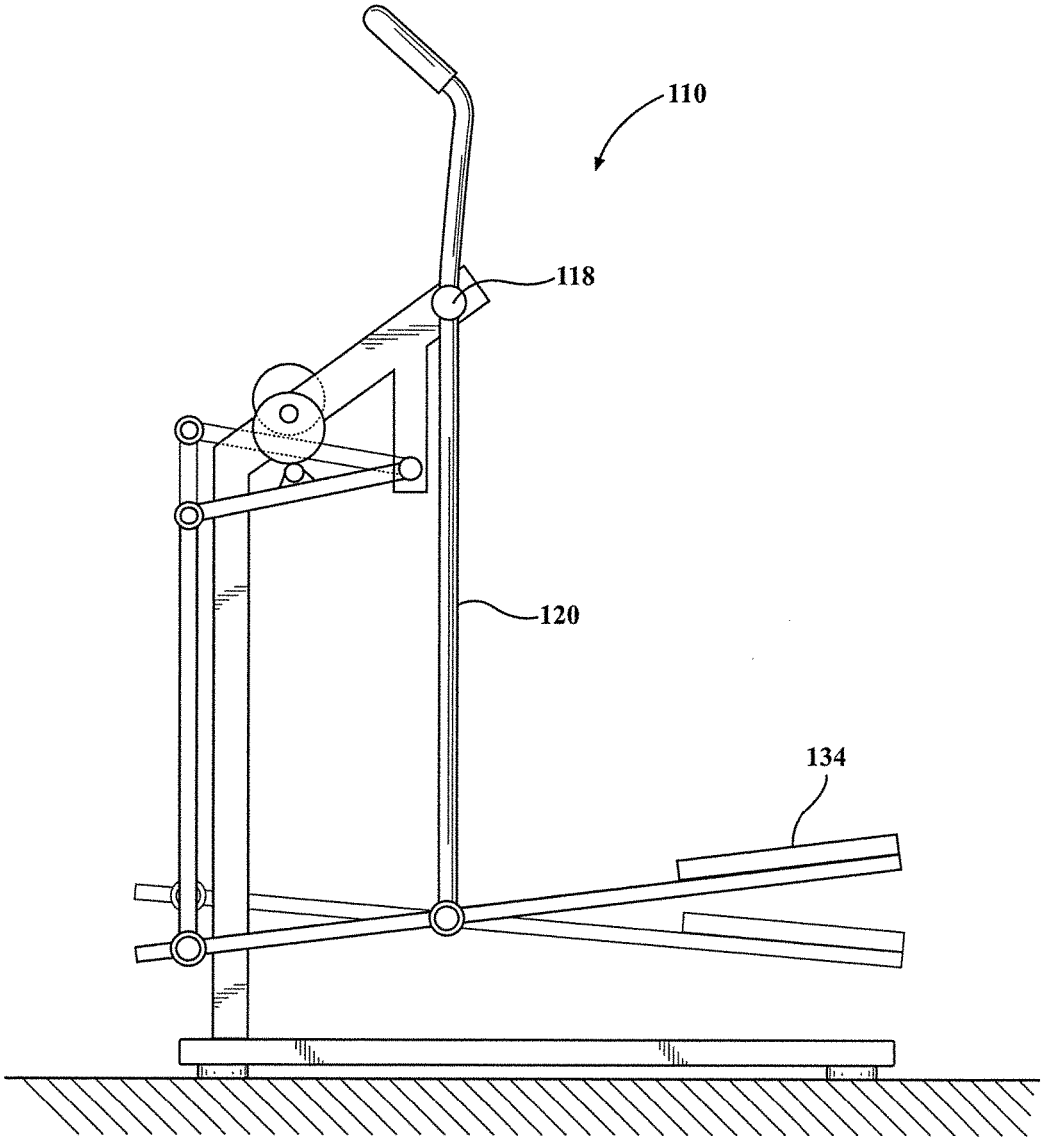
FIG. 2 is a side elevation view of a free stride embodiment of an elliptical exercise device in accordance with the present invention.

Referring now to FIG. 2, a free stride version of an elliptical exercise device is shown at 110. It is substantially the same as the version of FIG. 1, except that no crank portion, horizontal drive, or horizontal control links are provided. Instead, the pivotal motion of the guide links 120 about the first pivot axis 118 is decoupled from the motion of the foot receiving areas 134 along the path of travel having a vertical component of motion so that the user can achieve a foot path that is generally horizontal, generally vertical or a blend of horizontal and vertical motion. A free stride version also allows a user to adjust the length of the horizontal path of travel by exerting more or less fore-aft force to the foot receiving areas or hand grip areas. A flywheel and resistance assembly is not shown in FIG. 2 but would typically be included.

In both the fixed path version of FIG. 1 and the free stride version of FIG. 2, the foot support links and foot receiving areas are supported only by the guide links and the vertical control links. There is no track or other support for the foot support links and foot receiving areas.

Figure 4:
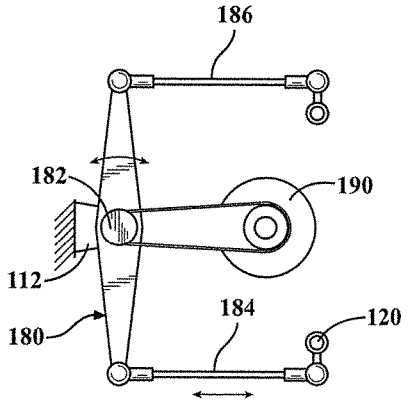
FIG. 4 is a top view of the linkage of FIG. 3.
Figure 3:
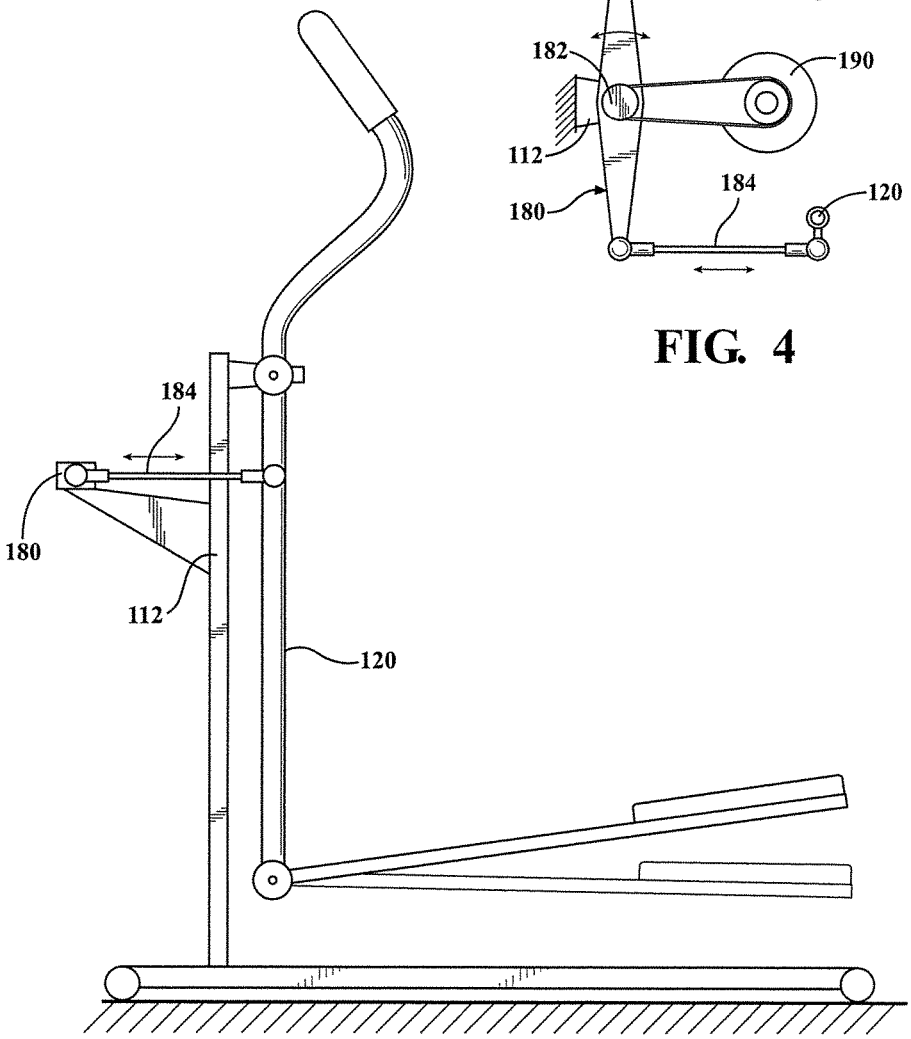
FIG. 3 is a side elevational view of a portion of an elliptical exercise device, showing a horizontal coordination linkage.

A free stride device in accordance with the present invention may include a mechanism to provide equal and opposite horizontal motion. This may take the form of a horizontal coordination linkage linking the first guide link to the second guide link such that pivotal movement of one of the guide links in a first direction causes pivotal movement of the other of the guide lines in an opposite direction. One version of such a mechanism is shown in FIGS. 3 and 4. FIG. 3 provides a side view of a portion of an exercise device, with the vertical control mechanism of FIG. 2 removed to simplify the drawing. FIG. 4 provides a top view of the horizontal control mechanism by itself. A horizontal rocker link 180 has a mid-portion 182 pivotally connected to the frame 112. A left horizontal control link 184 interconnects the left guide link 120 with one end of the rocker link 180 and a right horizontal control link 186 interconnects the right guide link with the other end of the rocker link. A second flywheel and resistance assembly 190 may be coupled to or associated with the horizontal control mechanism.

Figure 5:
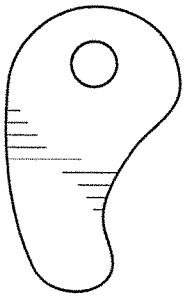
FIGS. 5-7 are drawings of exemplary alternative cam shapes that may be used with certain versions of the present invention.
Figure 6:
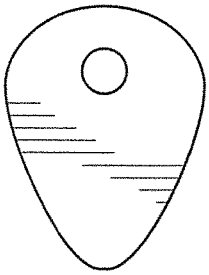
Figure 7:
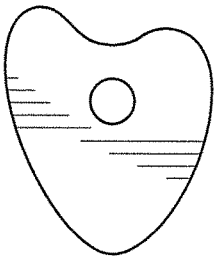
Figure 8:
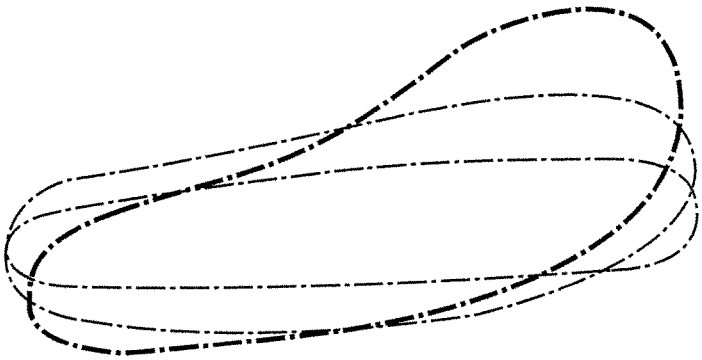
FIG. 8 is a schematic showing exemplary foot motion profiles that may be achieved through the use of different cam shapes.

FIGS. 5-7 show examples of alternative cam shapes to illustrate the flexibility of using a cam. The cam shape shown in FIGS. 1 and 2 may be referred to as a circular cam while other shapes, including those in FIGS. 5-7, may be referred to as a non-circular cam. FIG. 8 shows several exemplary foot motion profiles that may be achieved through the use of different cam shapes.

It is desirable to provide adjustment for the range of vertical and/or horizontal travel. Referring again to FIG. 1, a sliding collar 59 is provided on the forward portion 30 of the foot support link 28 and the lower end 58 of the vertical control link 56 is connected to the sliding collar 59. Adjusting the position of the sliding collar 59 will adjust the range of vertical travel. Similarly, a sliding collar 69 is provided on the guide link 20 and defines the attachment for the forward end 68 of the horizontal control link 64. Moving the collar 69 upwardly and downwardly on the guide link 20 adjusts the range of horizontal travel. This adjustment may be provided on any version.

FIGS. 9-13 show various additional adjustment mechanisms for adjusting vertical and/or horizontal travel. These mechanisms may be used with any of the embodiments herein as well as with other elliptical exercise device designs.

Figure 10:
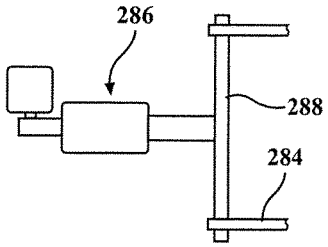
FIG. 10 is a top view of an actuator that forms part of the adjustment mechanism of FIG. 9.
Figure 9:
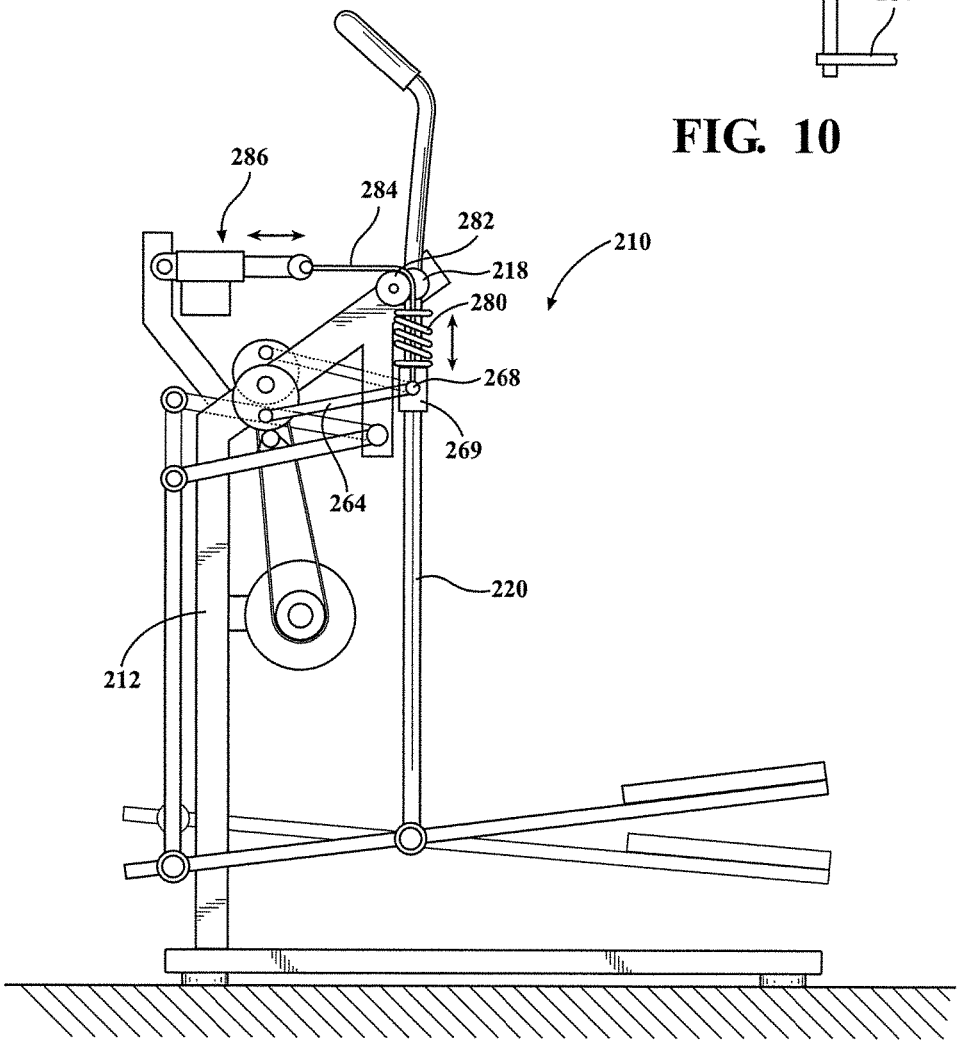
FIG. 9 is a side elevational view of an elliptical exercise device, showing one version of an adjustment mechanism.

FIG. 9 shows a fixed path elliptical exercise device 210 similar to the device 10 in FIG. 1. Only the elements that differ will be described. A sliding collar 269 is provided on the guide link 220 and defines the attachment point for the rearward end 268 of the horizontal control link 264. A spring 280 biases the collar 269 downwardly. A pulley 282 is supported on the frame at or near the first pivot axis 218. Alternatively, the pulley 282 may be on the guide link 220. A flexible element 284 is attached to the collar 269, extends upwardly and over the pulley 282, and connects to an actuator 286. FIG. 10 shows a top view of the actuator 286, which includes a cross bar 288 to which the flexible element 284 is attached. Similar components are provided for the other guide link. As such, the actuator can adjust the range of horizontal travel for both feet.

Figure 11:
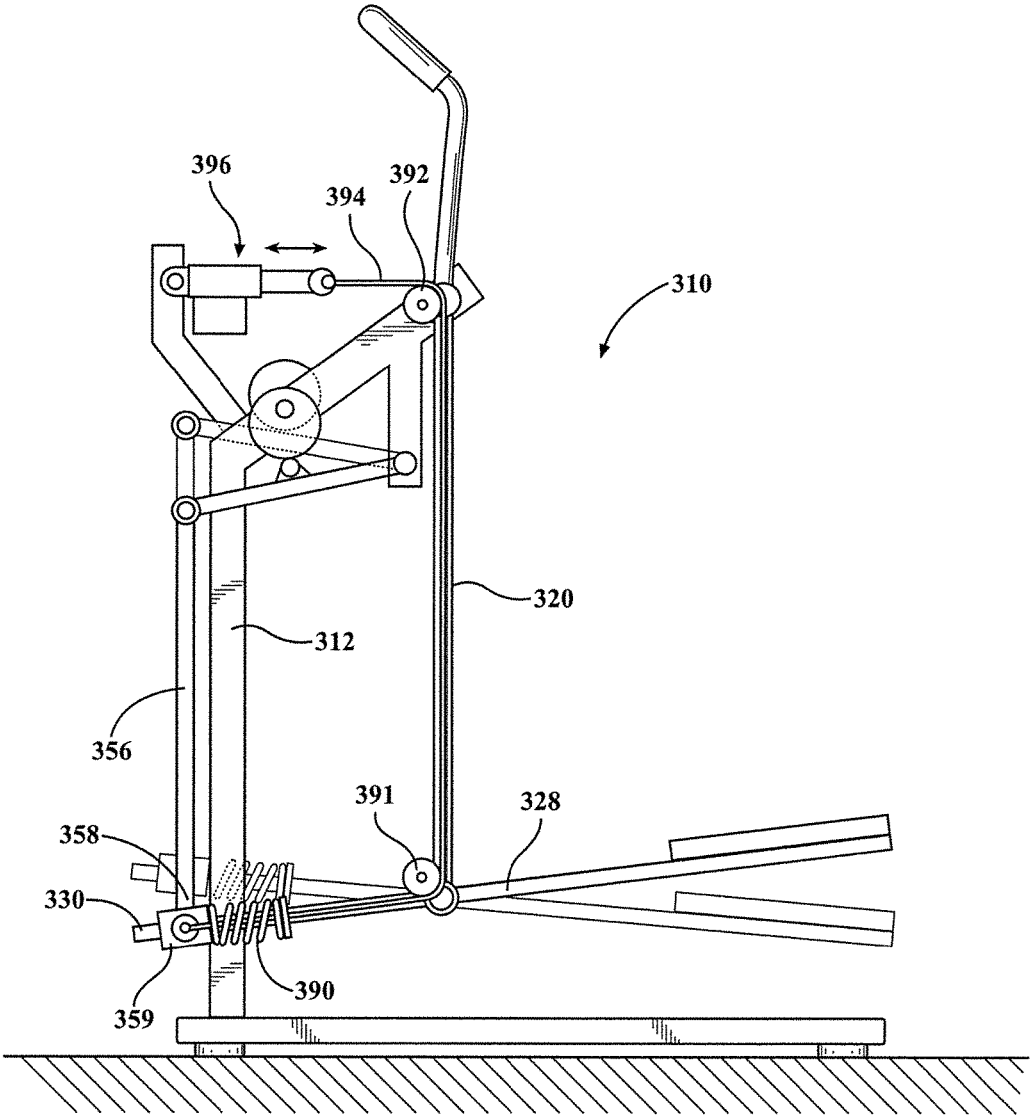
FIG. 11 is a side elevational view of an elliptical exercise device, showing another version of an adjustment mechanism.

FIG. 11 shows a free stride elliptical exercise device 310 similar to the device 110 in FIG. 2. Only the elements that differ will be described. A sliding collar 359 is provided on the forward portion 330 of the foot support link 328 and defines the attachment point for the lower end 358 of the vertical control link 356. A spring 390 biases the collar 359 forwardly. A lower pulley 391 is provided on the foot support link or guide link near to or at the connection between the guide link and foot support link. An upper pulley is supported on the frame at or near the first pivot axis 318. Alternatively, the pulley 392 may be on the guide link 320. A flexible element 394 is attached to the collar 359, extends rearwardly and around the lower pulley 391, up along the guide link 320, over the pulley 392, and forwardly to connect to an actuator 396. The actuator may be similar to the actuator 286, and is operable to move collars on both foot support links and thereby adjust the range of vertical travel.

Figures 12, 13:
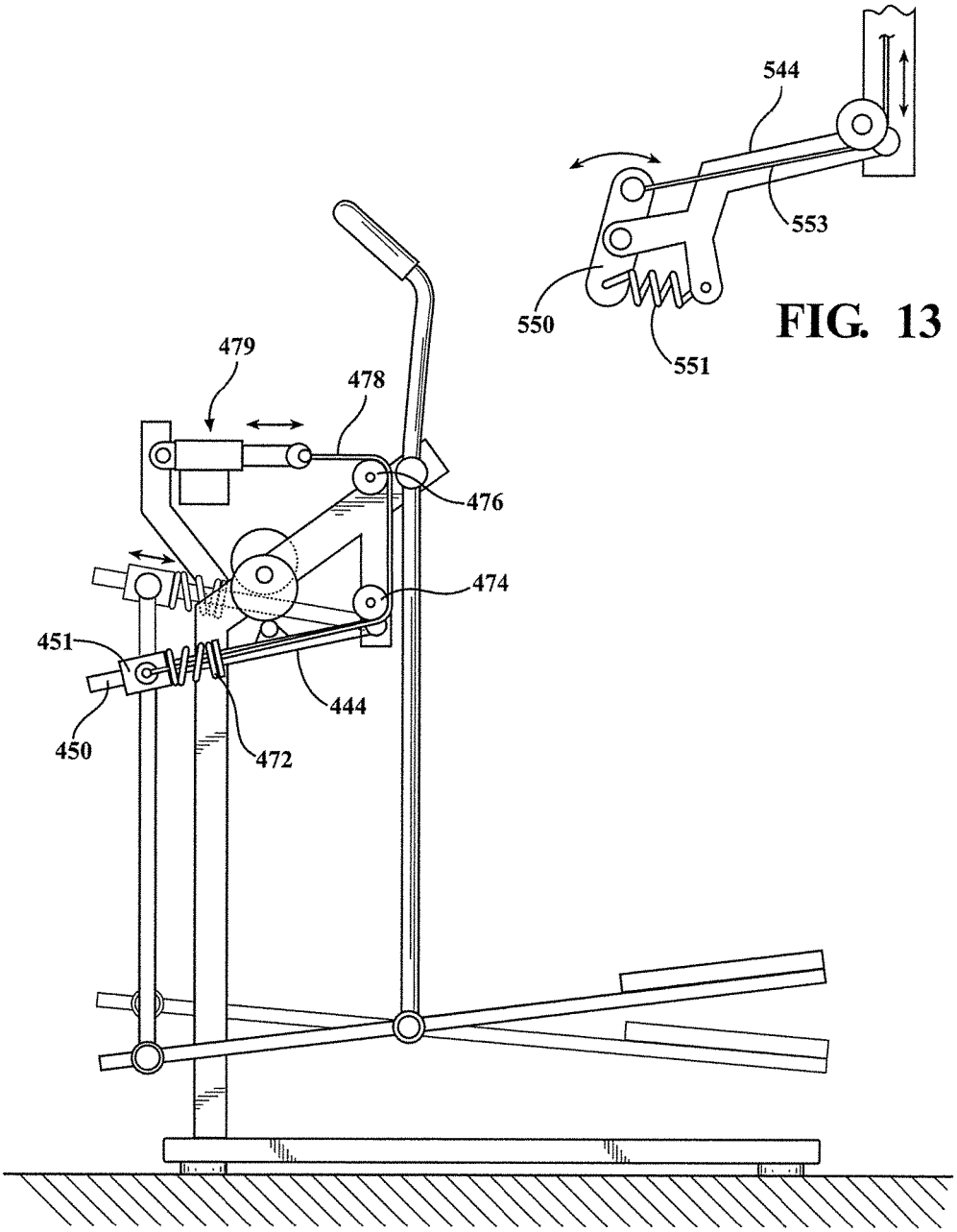
FIG. 12 is a side elevational view of an elliptical exercise device, showing yet another version of an adjustment mechanism.
FIG. 13 is a detailed view of an alternative structure for providing adjustment.

FIG. 12 shows a further alternative adjustment mechanism. In this version, a sliding collar 451 is provided on the control end 450 of the pivoting arm 444. A spring 472 biases the collar 451 forwardly. A lower pulley 474 is provided near or at the pivot end of the pivoting arm 444. An upper pulley 476 is provided above the lower pulley 474. A flexible element 478 attaches to the collar 451, extends rearwardly and around the lower pulley 474, extends upwardly and around the upper pulley 476, and extends forwardly to an actuator 479. The actuator is operable to adjust the position of collars on both pivoting arms to adjust the range of vertical travel.

FIG. 13 shows an alternative approach to adjusting the connection point to any of the links. FIG. 13 shows a pivoting arm 544 on which the control end 550 takes the form of a pivoting link that is attached to the pivoting arm. The pivoting link 550 has a mid-portion attached to the end of the arm 544 and a biasing spring 551 attached to one end of the link 550 and a flexible element 553 attached to the other. A vertical control link would attach to one end of the pivoting link 550 and my pivoting the pivoting link, the effective length of the pivoting arm is changed, thereby adjusting the range of vertical travel. This pivoting link approach may be applied to any of the other adjustment mechanisms discussed herein. Any of the adjustment mechanisms discussed herein may be combined with any of the other mechanism or used on any of the embodiments herein, as well as with other elliptical exercise devices. As one example, the adjustment mechanisms of FIGS. 9 and 11 may both be used in a fixed path device to provide adjustment of both horizontal and vertical travel. The adjustment of travel range may be manually or automatically controlled. For example, as a user changes the amount of horizontal travel, on either a free stride or a fixed stride embodiment, the range of vertical travel may be adjusted, such as by a control module that also senses the various travel parameters.

Figure 14B:
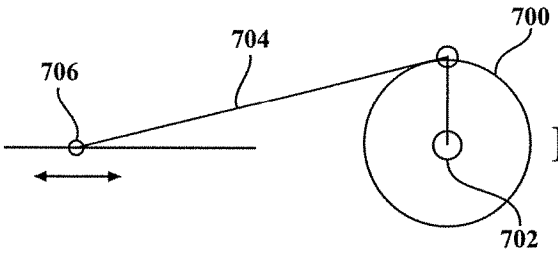
FIG. 14B is a schematic illustration of a typical crank system with a crank supported for rotation about a crank axis.
Figure 14A:
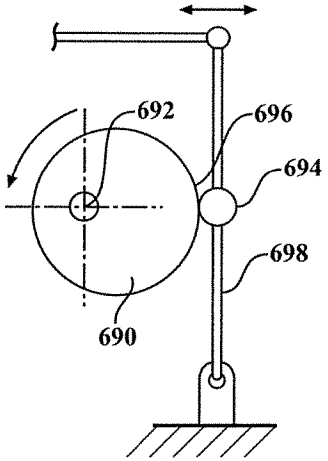
FIG. 14A is a schematic illustration of a cam supported for rotation about a cam axis and a follower in contact with an outer surface of the cam.
Figure 14C:
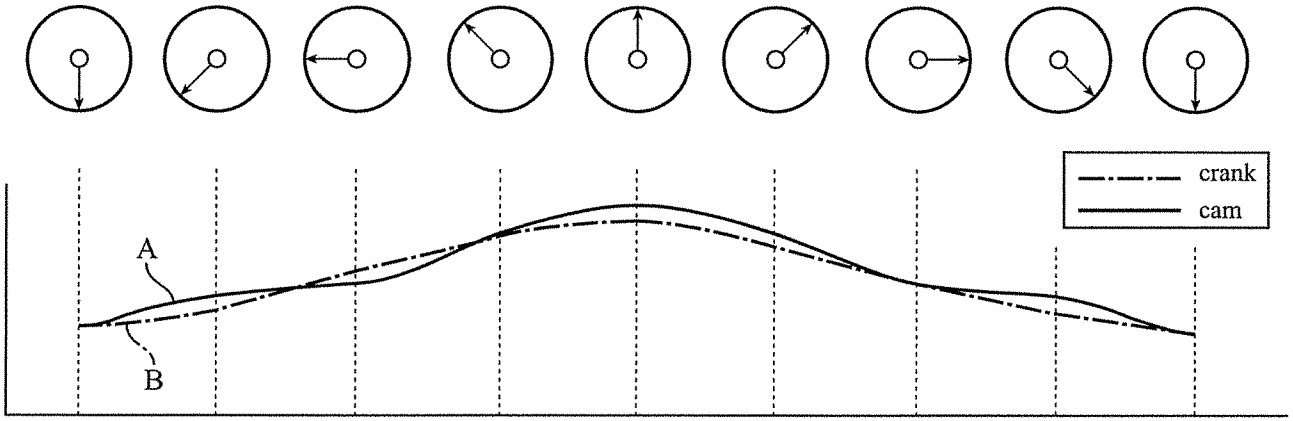
FIG. 14C is a graph comparing the motion caused by an exemplary cam/follower system and a crank system.

Embodiments of the present invention utilize a cam drive to control vertical travel. The use of a cam allows for a variety of motion profiles. FIG. 14A schematically illustrates a cam 690 supported for rotation about a cam axis 692. In this example, the cam has a circular shape but the circular cam has its center offset from the axis of rotation such that a follower 694 in contact with the outer surface 696 of the cam is oscillated back and forth with respect to the cam axis 692. A pivoting arm 698 is shown supporting the follower 694. FIG. 14B schematically illustrates a typical crank system with a crank 700 supported for rotation about a crank axis 702. A connecting rod or member 704 is connected to an outer point on the crank 700 such that as the crank rotates, an opposite end 706 of the connecting member 704 moves back and forth with respect to the crank axis 702. FIG. 14C compares the resulting motion of the follower 694 (curve A) and connecting member end 706 (curve B) as the respective cam and crank rotate. As shown, the resulting motion profile is not the same. The use of the cam provides a different result than the crank system and provides a different motion profile. As shown, the cam motion profile is not symmetrical with respect to top dead center (TDC). This motion profile provides certain advantages with respect to the resulting motion profile of the exercise device. The use of a cam and follower also allows flexibility in the range of motion, by altering the length and positioning of the pivoting arms. The use of non-circular cams allows further flexibility not achievable with a crank.

The foregoing describes some particular embodiments of the present invention. Other embodiments, modifications, and variations thereof will be apparent to those of skill in the art in view of the teaching presented herein. The foregoing is not meant to be a limitation upon the practice of the present invention. For example, any feature of any of the embodiments disclosed herein may be used with any other feature or embodiment disclosed herein. It is the following claims, including all equivalents, which define the scope of the invention.

The invention claimed is:

1. An elliptical exercise device comprising:

a frame configured to be supported on a horizontal surface, the frame having a first pivot axis and a second pivot axis defined thereon, the second pivot axis being forward of the first pivot axis, the frame further having a forward portion forward of the first pivot axis and a rearward portion rearward of the first pivot axis;

a first and a second guide link each having a first and a second attachment point defined thereon, each guide link being pivotally attached, through its first attachment point, to the frame at the first pivot axis thereof;

a first and a second foot support link each having a rear portion, a mid-portion and a forward portion, the rear portion of each support link defining a foot receiving area configured to support a user's foot thereupon, the mid portion of each foot support link being pivotally connected to the second attachment point of a respective one of the guide links so that when the guide links reciprocate relative to the frame, they each cause their respective foot support link to move in a path of travel having a horizontal component of motion;

a cam drive having a first and second cam supported for rotation about the second pivot axis and a first and a second pivoting arm engaging the respective first and second cams such that rotation of the cams causes movement of the pivoting arms;

a first and a second rigid vertical control link each having a first end coupled to the forward portion of a respective one of the foot support links and a second end coupled to a respective one of the pivoting arms of the cam drive such that rotation of the cams about the second pivot axis pivots the foot support links with respect to the guide links and the foot receiving areas move in a path of travel having a vertical component of motion, wherein the pivotal motion of the guide links about the first attachment points is decoupled from the motion of the foot receiving areas along the path of travel having a vertical component of motion so that the user can achieve a foot path that is generally vertical or generally horizontal or a blend of vertical and horizontal motion.

2. An elliptical exercise device in accordance with claim 1, wherein each of the guide links has a guide length defined between the first and second attachment point and each of the vertical control links has a length that is in the range of 60-100% of the guide length.

3. An elliptical exercise device in accordance with claim 1, wherein each of the vertical control links is generally parallel with the respective one of the guide links when the respective one of the guide links is generally vertical.

4. An elliptical exercise device in accordance with claim 1, wherein the foot support links are supported for movement only by the respective guide link and vertical control link.

5. An elliptical exercise device in accordance with claim 1, wherein each of the cams has a generally non-circular shape.

6. An elliptical exercise device in accordance with claim 1, wherein the pivoting arms each have a pivot end, an opposite control end, and a midportion therebetween, the second end of each of the vertical control links connected to the control end of a respective one of the pivoting arms.

7. An elliptical exercise device in accordance with claim 6, wherein the pivot arms each further having a follower connected to the midportion, each follower contacting an outer surface of a respective one of the cams.

8. An elliptical exercise device in accordance with claim 6, wherein each pivoting arm is generally horizontal when the respective foot receiving area is midway through its vertical path of travel.

9. An elliptical exercise device in accordance with claim 6, wherein the pivot end of the pivoting arms is rearward of the control end.

10. An elliptical exercise device in accordance with claim 6, wherein the pivoting arms are disposed below the cams such that each cam pushes downwardly on the respective pivoting arm.

11. An elliptical exercise device in accordance with claim 1, wherein the first pivot axis is higher than the second pivot axis.

12. An elliptical exercise device in accordance with claim 1, wherein the foot support links are generally horizontal when the respective foot receiving area is midway through its vertical path of travel.

13. An elliptical exercise device in accordance with claim 1, wherein each guide link further includes a hand grip portion extending upwardly from the first attachment point.

14. An elliptical exercise device in accordance with claim 1, further comprising a horizontal coordination linkage linking the first guide link to the second guide link such that pivotal movement of one of the guide links in a first direction causes pivotal movement of the other of the guide lines in an opposite direction.

15. An elliptical exercise device in accordance with claim 14, further comprising a flywheel and resistance assembly coupled to the horizontal coordination linkage.

16. An elliptical exercise device in accordance with claim 1, further comprising a flywheel and resistance assembly coupled to the cam drive.

17. An elliptical exercise device in accordance with claim 1, further comprising an adjustment mechanism for adjusting a range of vertical travel.

18. An elliptical exercise device in accordance with claim 17, wherein the adjustment mechanism comprises a first sliding collar coupled to the first pivoting arm and a second sliding collar coupled to the second pivoting arm, the second end of each of the vertical control links being coupled to the sliding collar of the respective pivoting arm, the adjustment mechanism further comprising an actuator operable to move the sliding collars on the pivoting arms.

19. An elliptical exercise device in accordance with claim 18, wherein the adjustment mechanism further comprises:

a first and a second biasing element each biasing a respective one of the sliding collars away from the pivot end of the respective one of the pivoting arms; and a first and a second flexible element each connecting a respective one of the sliding collars to the actuator such that movement of the actuator causes movement of the sliding collars.

20. An elliptical exercise device in accordance with claim 17, wherein the adjustment mechanism comprises a first sliding collar coupled to the forward end of the first foot support link and a second sliding collar coupled to the forward end of the second foot support link, the first end of each of the vertical control links being coupled to the sliding collar on the respective foot support link arm, the adjustment mechanism further comprising an actuator operable to move the sliding collars on the foot support links.

21. An elliptical exercise device in accordance with claim 20, wherein the adjustment mechanism further comprises:

a first and a second biasing element each biasing a respective one of the sliding collars away from the mid portion of the respective one of the foot support links; and a first and a second flexible element each connecting a respective one of the sliding collars to the actuator such that movement of the actuator causes movement of the sliding collars.

22. An elliptical exercise device in accordance with claim 17, wherein the adjustment mechanism is operable to automatically adjust the range of vertical travel as the user changes the range of horizontal travel.

* * * * *